US007654458B1

(12) United States Patent
Kokodis et al.

(10) Patent No.: US 7,654,458 B1
(45) Date of Patent: Feb. 2, 2010

(54) DUAL PURPOSE MUNITION

(75) Inventors: Victor N. Kokodis, Wharton, NJ (US); Arnold S. Klein, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 779 days.

(21) Appl. No.: 11/306,024

(22) Filed: Dec. 14, 2005

Related U.S. Application Data

(66) Substitute for application No. 60/593,147, filed on Dec. 15, 2004.

(51) Int. Cl.
*G06F 19/00* (2006.01)

(52) U.S. Cl. ..... 235/400; 89/6.5; 102/221

(58) Field of Classification Search ..... 235/400; 89/6.5; 102/221
See application file for complete search history.

(56) References Cited

U.S. PATENT DOCUMENTS 3,916,760 A * 11/1975 Sewell et al. ..... 89/1.56
6,557,450 B1 * 5/2003 Cox et al. ..... 89/6.5
2004/0244625 A1 * 12/2004 Tiernan et al. ..... 102/221

* cited by examiner

*Primary Examiner*—Allyson N Trail
(74) *Attorney, Agent, or Firm*—John F. Moran

(57) ABSTRACT

A dual purpose munition includes a housing; a shaped warhead disposed in a front interior of the housing; a vertically orienting explosive disposed on a front end of the housing; a safe and arm device explosively connected to the shaped warhead for arming and detonating the shaped warhead; a dual sensor circuit comprising an E-field sensor board, a B-field sensor board and a processor board; and a power source connected to the dual sensor circuit and the safe and arm device.

12 Claims, 2 Drawing Sheets

DUAL PURPOSE MUNITION

CROSS-REFERENCE TO RELATED APPLICATIONS

This application claims the benefit under 35 USC 119(e) of U.S. provisional patent application 60/593,147 filed on Dec. 15, 2004, which is incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to a dual purpose munition with sensors to discriminate between personnel and vehicles.

Previous grenades have either been time fused, whereby the warhead is initiated once an internal timer times out, or impact fused, whereby physical contact with the intended target has to occur. In the time fused grenade, if the target is not near the grenade when the timer times out, then the grenade may not be effective. In the impact fused grenade, if the grenade impacts something other than the target, then the grenade may not be effective.

At the time of detonation, previous grenades were generally oriented in whatever position they had acquired, whether in flight or on the ground. Thus, previous grenades were usually not oriented in the most lethal position with respect to the intended target. In addition, previous grenades were typically optimized to destroy a particular type of target, for example, either vehicles or personnel, but not both.

SUMMARY OF THE INVENTION

It is an object of the invention to provide a munition that detonates based on the sensing of electrical and magnetic fields.

It is another object of the invention to provide a munition with both anti-vehicle and anti-personnel capabilities.

A further object of the invention is to provide a munition having a vertically oriented warhead.

Still another object of the invention is to provide a munition that is designed to detonate underneath a vehicle.

One aspect of the invention is a munition comprising a housing; a shaped warhead disposed in a front interior of the housing; a vertically orienting explosive disposed on a front end of the housing; a safe and arm device explosively connected to the shaped warhead for arming and detonating the shaped warhead; a dual sensor circuit comprising an E-field sensor board, a B-field sensor board and a processor board; and a power source connected to the dual sensor circuit and the safe and arm device.

The processor combines signals from the E-field and B-field sensor boards to determine whether a target is personnel or a vehicle and, if the target is personnel, the safe and arm device initiates the vertically orienting explosive and then initiates the shaped warhead. If the target is a vehicle, the processor determines from the B-field sensor board when the vehicle is above the munition and then the safe and arm device initiates the vertically orienting explosive and initiates the shaped warhead.

At least a part of the housing is scored so that detonation of the shaped warhead causes fragmentation of the housing. A timed self-destruct circuit causes initiation of the shaped warhead after an elapsed time. An impact switch may be used for initiating the dual sensor circuit. The munition may further comprise a shell casing and propellant in the shell casing wherein the rear end of the munition is disposed in the shell casing.

Another aspect of the invention is a method of detonating a munition comprising providing a munition as described above; arming the shaped warhead; detecting a target using the dual sensor circuit; if the detected target is a person, vertically orienting the munition and detonating the shaped warhead; and if the detected target is a vehicle, monitoring a B-field signal to determine when the vehicle is above the munition and, when the vehicle is above the munition, vertically orienting the munition and detonating the shaped warhead.

The method preferably comprises launching the munition from a tube. The method may further comprise self-destructing the munition after an elapsed time. After detonation of the warhead, the method comprises fragmenting at least a part of the housing of the munition. The step of vertically orienting the munition may comprise initiating an energetic device disposed on the front end of the housing.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
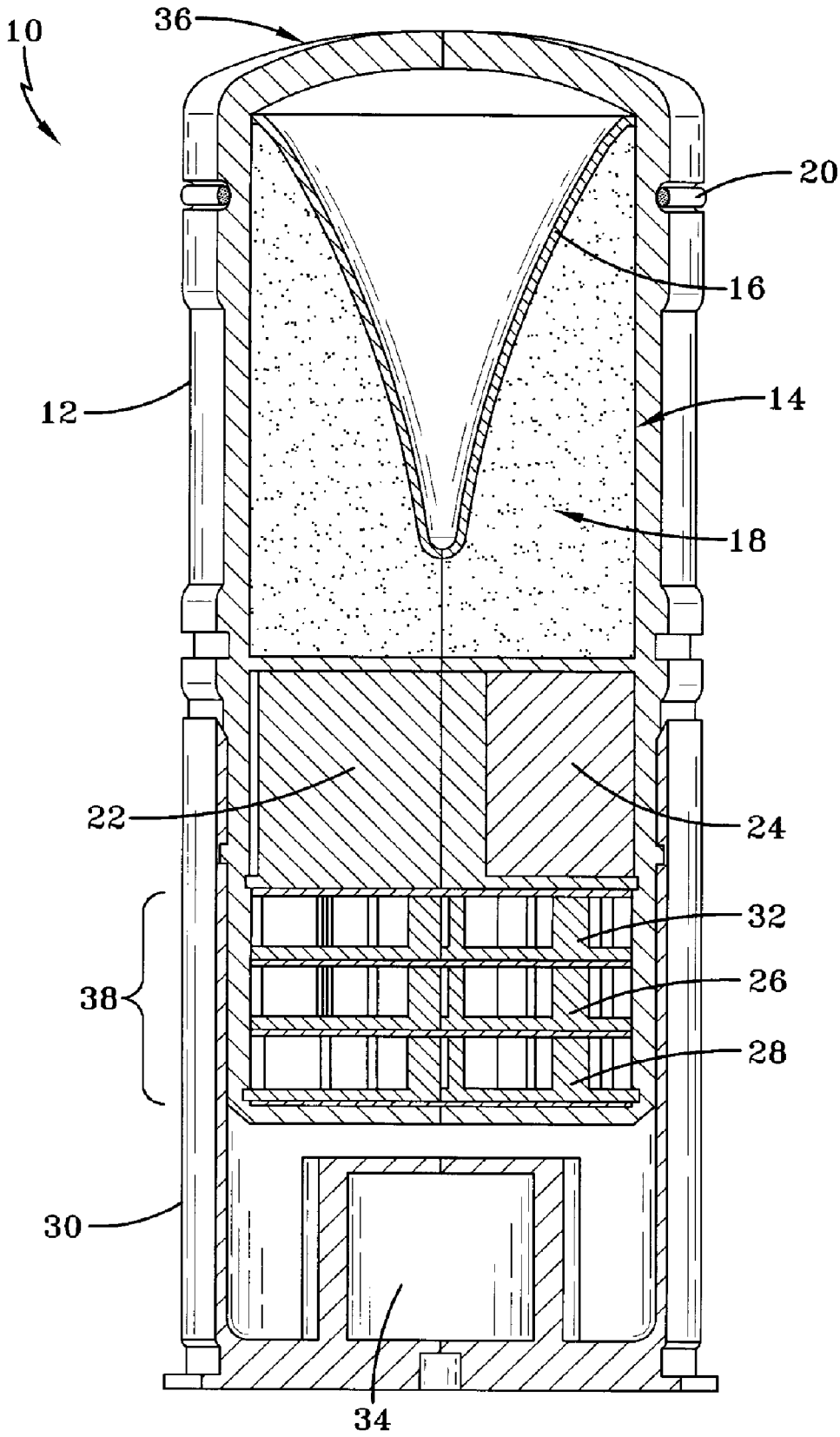
FIG. 1 is a schematic sectional view of one embodiment of a dual purpose munition in accordance with the invention.

The present invention is a dual purpose munition (DPM) that may be realized in the form of a 40 mm grenade, although other sizes are within the scope of the invention. The 40 mm size allows the emplacement of the DPM with available gun systems such as the Mk-19 40 mm machinegun, M 203 grenade launcher and Metal Storm dispenser system. The DPM may also be dropped from an air frame dispenser or by hand.

The DPM provides two modalities, anti-tank/anti-vehicle and anti-personnel. The two modalities improve logistics by not requiring two separate munition types. The DPM has a vertically orienting warhead to improve performance against vehicles. The capability of engaging threat vehicles from underneath improves the probability of disabling the vehicles with a small warhead. The DPM provides the ability to emplace a short term barrier by laying down an array of the DPMs in a selected area.

The DPM is a sensor fused grenade which can detect and distinguish between humans and vehicles and then engage with a dual purpose warhead. With the DPM, internal sensors are used to detect the target from a distance, without requiring physical contact. The onboard sensors enable the DPM to distinguish between personnel and vehicles, thus allowing a single version of the grenade to perform both functions. The sensors allow the DPM grenade to be emplaced at the desired location and linger until a target is detected or a preset time expires and the DPM self destructs. The DPMs create a barrier quickly and only when needed, thus eliminating the problem of having energetic devices in the battle field after the conflict has ended.

The DPM grenade uses a dual sensor approach, such as a magnetic/electric field system, to detect the target and distinguish between personnel and vehicles. Once it is determined whether the target is personnel or a vehicle, the DPM reacts in one of two ways. If the target has been identified as a vehicle, the DPM waits for the vehicle to over-pass it. The magnetic portion of the dual sensor then triggers an orientation mechanism to upright the DPM grenade and detonate the warhead. If the target is identified as personnel, the dual sensor immediately triggers the orientation mechanism and then detonates the warhead.

The DPM comprises a shape charge warhead which is used to engage moving vehicles from below during an over-pass. The DPM is oriented vertically to aim the warhead towards the belly of the target vehicle. One way of vertically orienting the DPM is to initiate a small explosive device placed towards the front of the DPM. The initiation of the small explosive device reacts against the ground and the opposing force causes the DPM to rotate itself upwards. In one embodiment, a mild detonating cord is placed in the leading edges of the DPM to provide the explosive means to vertically orient the DPM.

The DPM uses the same warhead to engage personnel and vehicles. In the case of personnel, rather than relying on the shape charge for the engagement, the explosive within the warhead causes the DPM housing to form fragments which engage the personnel targets. The vertical orientation mechanism allows the DPM to more uniformly disperse in a 360 degree pattern. The orientation feature allows the DPM to defeat targets with a smaller warhead because the warhead is aimed at the most vulnerable location with respect to vehicles and personnel targets.

FIG. 1 is a schematic sectional view of one embodiment of a DPM 10 in accordance with the invention. The DPM 10 includes a housing 12 having a front end 36; a shaped warhead 14 disposed in the front interior of the housing 12; a vertically orienting explosive 20 disposed on the front end 36 of the housing 12; a safe and arm device 22 explosively connected to the shaped warhead 14 for arming and detonating the shaped warhead 14; a dual sensor circuit 38 comprising an E-field sensor board 26, a B-field sensor board 28 and a processor board 32; and a power source 24 connected to the dual sensor circuit 38 and the safe and arm device 22.

Figure 2:
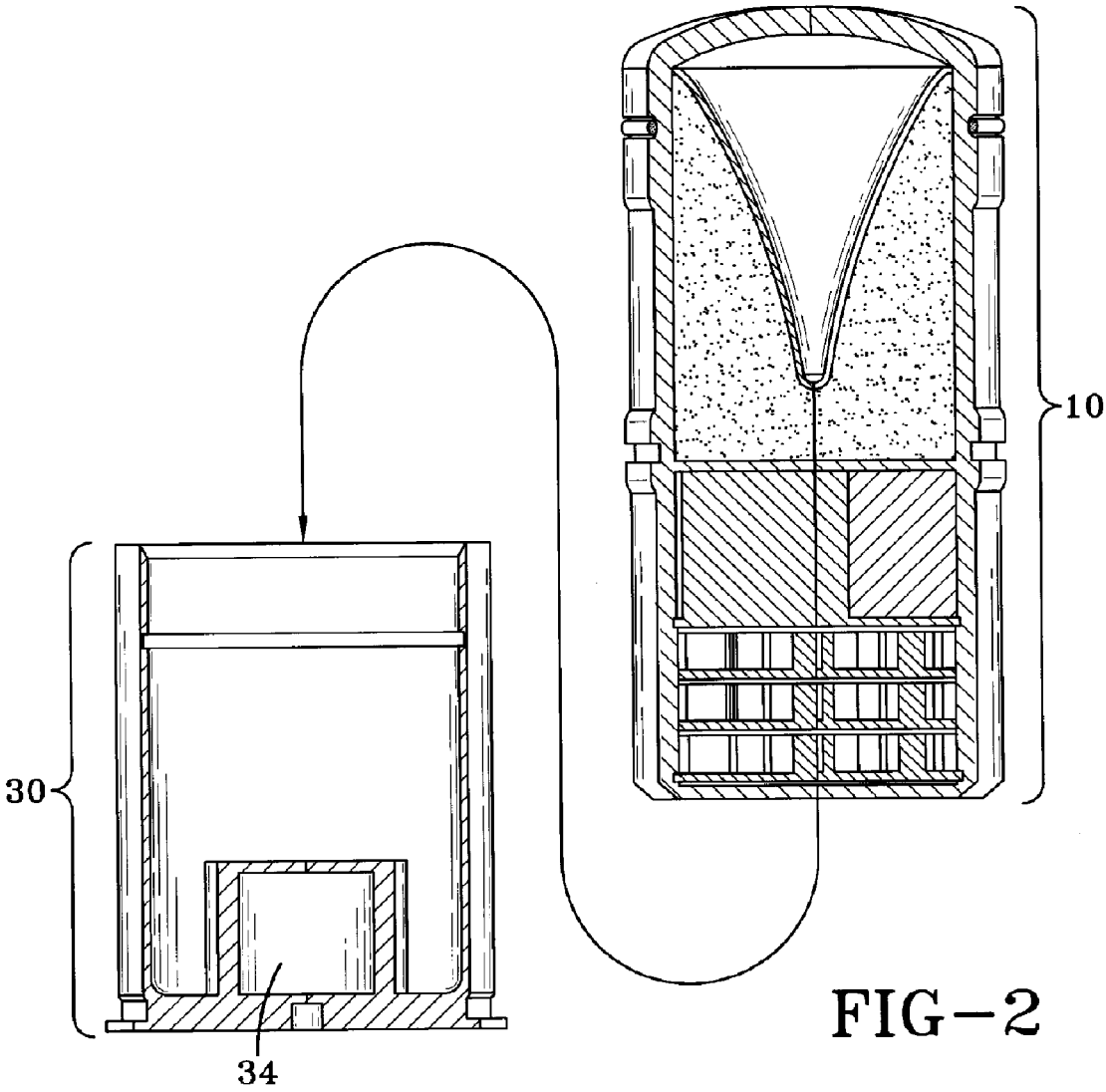
FIG. 2 is an exploded view of FIG. 1.

In the embodiment of FIG. 1, DPM 10 is disposed in a shell casing 30 having propellant 34 in its base. When fired from a gun or tube, the shell casing 30 remains in the gun or tube while the DPM 10 is launched. FIG. 2 shows the shell casing 30 and DPM 10 separated. If not fired from a gun or tube, the DPM 10 could be dropped from an air frame dispenser or by hand, without the shell casing 30 and propellant 34.

The shaped warhead 14 is known and comprises an explosive 18 formed behind a liner 16. The vertically orienting explosive 20 may comprise an energetic device such as a ring of detonation cord that encircles the front end 36 of the housing 12. The safe and arm device 22 is known and operates to arm the shaped warhead 14 contingent on one or more preconditions or combination of preconditions. Such preconditions may include set forward acceleration, setback acceleration, spin, centrifugal force, impact or time delay.

The dual sensor circuit 38 comprises a geoelectric field sensor (E-field sensor) board 26, a geomagnetic field sensor (B-field) board 28 and a processor board 32. Quasi-static electricity generated by humans and vehicles causes a local temporal perturbation in the geoelectric field. These perturbations, although small, can be detected and measured using the E-Field sensor board 26. Geoelectric field perturbations caused by passing humans and vehicles have very different and easily recognizable structures. The B-Field sensor board 28 measures the geomagnetic field perturbations due to passing humans and vehicles. The processor board 32 processes and data-fuses the outputs of the E-Field and B-Field sensor boards 26, 28 to detect and differentiate between a human and a vehicle (automobile, truck, armored personnel carrier, tank, etc.). An exemplary dual sensor circuit 38 is disclosed in U.S. provisional patent application Ser. No. 60/593,283 filed on Jan. 4, 2005, which is hereby incorporated by reference. An impact switch may be included in the dual sensor circuit 38 to start the E-field and B-field sensor boards 26, 28 upon impact of the munition 10.

Figure 3:
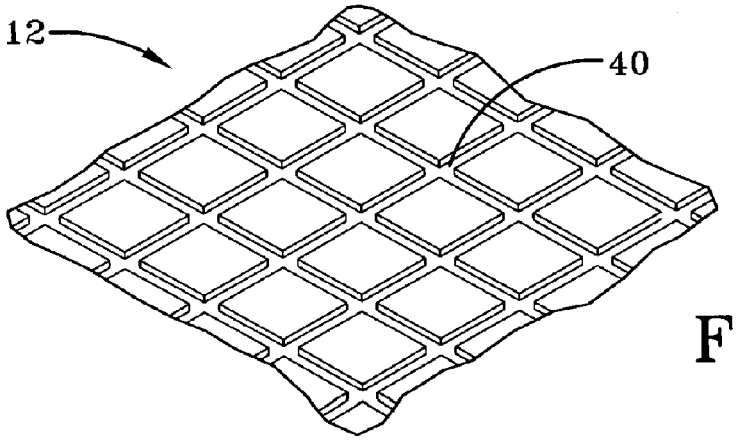
FIG. 3 is a view of part of the exterior of the housing.

The processor 32 combines signals from the E-field and B-field sensor boards 26, 28 to determine whether a target is personnel or a vehicle and, if the target is personnel, the safe and arm device 22 initiates the vertically orienting explosive 20 and then initiates the shaped warhead 14. As shown in FIG. 3, the exterior surface of at least part of the housing 12 includes scoring 40 such that, upon detonation of the shaped warhead 14, the housing 12 creates fragments. Because the munition 10 has been vertically oriented prior to detonation of the shaped warhead 14, the fragments from the housing are dispersed in a 360 degree array. These fragments are lethal to personnel.

If the target is a vehicle, the processor 32 determines from the B-field sensor board 28 when the vehicle is above the munition 10. The processor 32 monitors the change in the B-field reading. As the vehicle approaches the munition 10, the B-field reading rises until the centroid of the vehicle is reached. Once the centroid passes over the munition 10, the B-field signal begins to weaken. This change in the B-field signal is the trigger to vertically orient the munition 10 and then detonate the shaped warhead 14. Because the shaped warhead 14 is directly beneath the target vehicle, the munition 10 is especially lethal.

The safe and arm device 22 may include a timed self-destruct circuit that causes initiation of the shaped warhead 14 after an elapsed time. In this way, the barrier of munitions 10 has a predictable life span. The self-destruct circuit helps to eliminate the problem of unexploded ordnance on the battlefield.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A munition, comprising:

a housing;

a shaped warhead disposed in a front interior of the housing;

a vertically orienting explosive disposed on a front end of the housing;

a safe and arm device explosively connected to the shaped warhead for arming and detonating the shaped warhead;

a dual sensor circuit comprising an E-field sensor board, a B-field sensor board and a processor board; and a power source connected to the dual sensor circuit and the safe and arm device;

wherein the processor combines signals from the E-field and B-field sensor boards to determine whether a target is personnel or a vehicle and, if the target is personnel, the safe and arm device initiates the vertically orienting explosive and then initiates the shaped warhead and further wherein, if the target is a vehicle, the processor determines from the B-field sensor board when the vehicle is above the munition and then the safe and arm device initiates the vertically orienting explosive and initiates the shaped warhead.

2. The munition of claim 1 wherein at least a part of the housing is scored so that detonation of the shaped warhead causes fragmentation of the housing.

3. The munition of claim 1 further comprising a timed self-destruct circuit that causes initiation of the shaped warhead after an elapsed time.

4. The munition of claim 1 further comprising an impact switch for initiating the dual sensor circuit.

5. The munition of claim 1 wherein the vertically orienting explosive comprises detonation cord.

6. The munition of claim 1 further comprising a shell casing and propellant in the shell casing, a rear end of the munition being disposed in the shell casing.

7. A munition having a housing; a shaped warhead disposed in a front interior of the housing; a vertically orienting explosive disposed on a front end of the housing; a safe and arm device explosively connected to the shaped warhead for arming and detonating the shaped warhead; a dual sensor circuit comprising an E-field sensor board, a B-field sensor board and a processor board; and a power source connected to the dual sensor circuit and the safe and arm device; wherein the processor combines signals from the E-field and B-field sensor boards to determine whether a target is personnel or a vehicle and, if the target is personnel, the safe and arm device initiates the vertically orienting explosive and then initiates the shaped warhead and further wherein, if the target is a vehicle, the processor determines from the B-field sensor board when the vehicle is above the munition and then the safe and arm device initiates the vertically orienting explosive and initiates the shaped warhead by a method of:

arming the shaped warhead;

detecting a target using the dual sensor circuit;

if the detected target is a person, vertically orienting the munition and detonating the shaped warhead; and if the detected target is a vehicle, monitoring a B-field signal to determine when the vehicle is above the munition and, when the vehicle is above the munition, vertically orienting the munition and detonating the shaped warhead.

8. The method of claim 7 further comprising self-destructing the munition after an elapsed time.

9. The method of claim 7 further comprising launching the munition from a tube.

10. The method of claim 7 further comprising starting the dual sensor circuit upon impact of the munition.

11. The method of claim 7 further comprising fragmenting at least a part of the housing of the munition after detonation of the shaped warhead.

12. The method of claim 7 wherein vertically orienting the munition comprises initiating an energetic device disposed on the front end of the housing.

* * * * *